10/22/85 XR 4,548,579

United States Patent [19]

Cunningham

[11] Patent Number: 4,548,579

[45] Date of Patent: Oct. 22, 1985

[54] COMPOUND REDUCING OVEN

[75] Inventor: Roger D. Cunningham, Jackson, Mich.

[73] Assignee: Blu-Surf, Inc., Parma, Mich.

[21] Appl. No.: 519,481

[22] Filed: Aug. 1, 1983

[51] Int. Cl.[4] ..... F23J 15/00

[52] U.S. Cl. ..... 432/72; 110/210; 110/211

[58] Field of Search ..... 432/72, 59; 110/210, 110/211, 214

[56] References Cited

U.S. PATENT DOCUMENTS

| | | | |
|---|---|---|---|
| 3,043,246 | 7/1962 | Herbert | 110/211 |
| 3,604,824 | 9/1971 | Hardison | 432/72 |
| 3,788,244 | 1/1974 | Polsak et al. | 110/215 |
| 3,898,040 | 8/1975 | Tabak | 110/211 |
| 4,098,567 | 7/1978 | Hubbert | 432/72 |
| 4,152,399 | 5/1979 | Germerdonk et al. | 432/72 |
| 4,324,545 | 4/1982 | Hubbert | 432/72 |
| 4,459,922 | 7/1984 | Chadshay | 110/265 |

*Primary Examiner*—Henry C. Yuen

*Attorney, Agent, or Firm*—Price, Heneveld, Huizenga & Cooper

[57] ABSTRACT

Treating and reducing solvent emissions from a gaseous stream, containing volatile organic compounds, discharged from a paint spray booth, resulting in the generation of heat which is used as for heat treating and drying the protective coatings. The apparatus employs a pressurization chamber in which the pollutant laden gaseous stream is pressurized, and raised in temperature as it is controllably flowed past a burner, combusting the volatilized organic substances therein.

6 Claims, 4 Drawing Figures

COMPOUND REDUCING OVEN

BACKGROUND OF THE INVENTION

Spray booths usually have little or no solvent reducing apparatus attached thereto, resulting in solvent or pollutant laden stack discharges into the atmosphere. If treatment of spray booth exhaust is employed, it typically comprises filtration, dry or wet, and/or various absorption methods, or direct flame incineration. These methods require significant capital outlay. In the case of incineration, large volumes of generated heat are typically discharged into the atmosphere.

SUMMARY OF THE INVENTION

The present invention effectuates more efficient and rapid incineration of solvent laden gaseous streams, particularly volatile organic compound (V.O.C.) emissions, using less equipment, resulting in ecologically improved stack discharge and using the heat for the drying oven for the coated products. Organic compounds are removed from the discharge air stream, curbing pollution causing stack discharge while resulting in less fuel consumption. With the flow circuit and apparatus of the invention the solvents and pollutants are combusted in a special pressurized combustion chamber, at a relatively high temperature. The gases are combusted under pressure in the range of 1-2 psig. Flow of the gases past a frustoconical burner is regulated by a profile defining iris peripherally around the burner and radially variable to form an optimum flow passage for the particular concentration of combustible materials encountered. The resulting gases are processed through a network of duckwork and piping to provide heat for the drying process. One advantageous feature of the invention is its adaptability to existing equipment, more specifically to existing process lines. The novel apparatus, being smaller in size and shorter in length than prior art apparatus, allows replacement integration into existing process lines without expensive rework or relocation of such process lines. This invention renders available to users the capacity to control stack discharge for curbing air pollution of combustible materials to meet pollution standards, yet the amount of equipment is lessened over that previously required rather than increased as might be expected. Experimental operations on a trial basis under actual conditions of coating or spraying parts shows that the invention enables fuel conservation, increased production rates and less equipment along with curbed stack output for pollution control.

Because the invention was conceived and developed for volatile organic compound incineration from paint spray booths, and is particularly useful for such, it will be described herein chiefly in this context. However the concept in its broader aspects could be adapted to solvent treatment processes from a variety of generated sources such as tank vapors or collected vapors from roll coating operations or the like.

DETAILED DESCRIPTION OF THE PREFERRED EMBODIMENT

Figure 1:
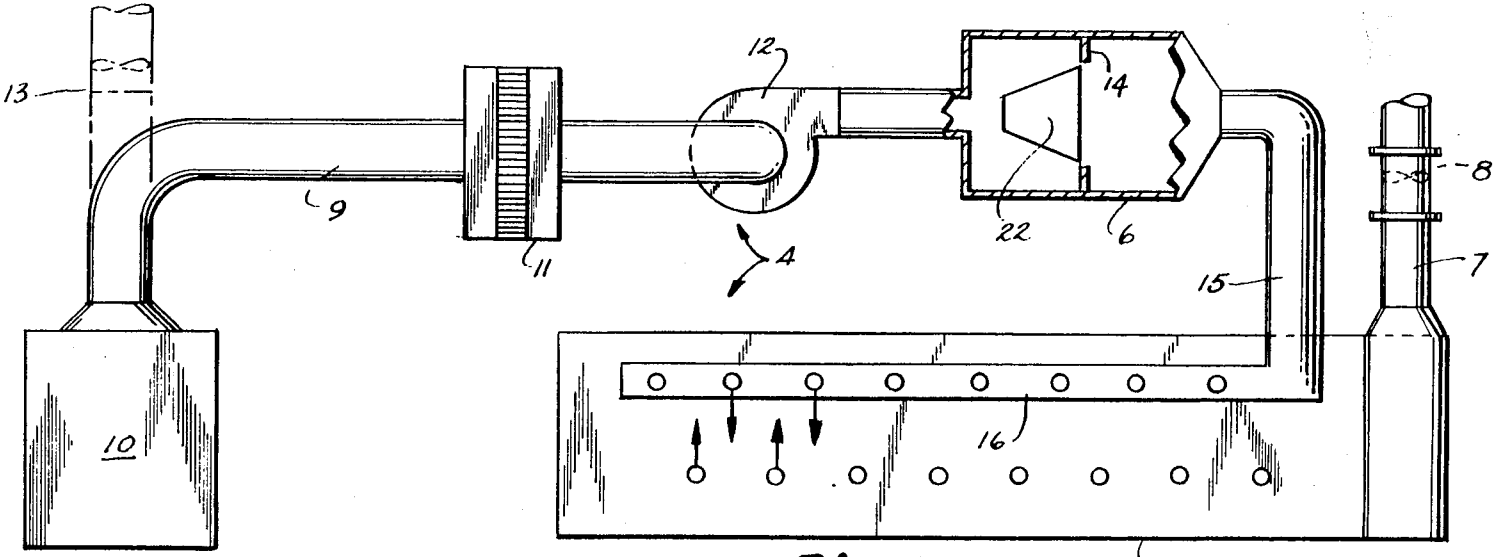
FIG. 1 is an elevational view of the oven apparatus employing the invention.
Figure 2:
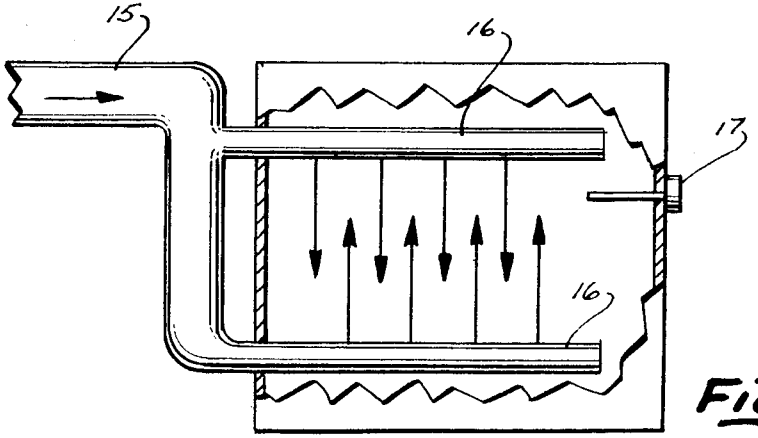
FIG. 2 is an end elevational view of the input end of the apparatus in FIG. 1.
Figure 3:
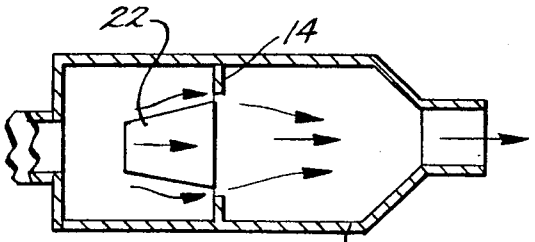
FIG. 3 is a sectional view of the burner combustion chamber showing the combustion concept.

The application of protective coatings on metal fabricated parts typically involves the use of a spray booth or other enclosure to contain the vapors. Referring now specifically to the drawings, in FIG. 1 is depicted an illustrative assembly of the novel apparatus 4, including an oven 5, combustion burner subassembly 6, exhaust stack unit 7, exhaust fan 8 and a cooperative system of ducting 9, a spray booth 10, a filter 11 and an air propelling pressure blower unit 12. Downstream of the combustion burner subassembly is ducting 15 leading to piping 16 in oven 18. The oven is shown to include one zone or section. The number of oven intermediate zones or sections could vary to suit a particular usage.

Figure 4:
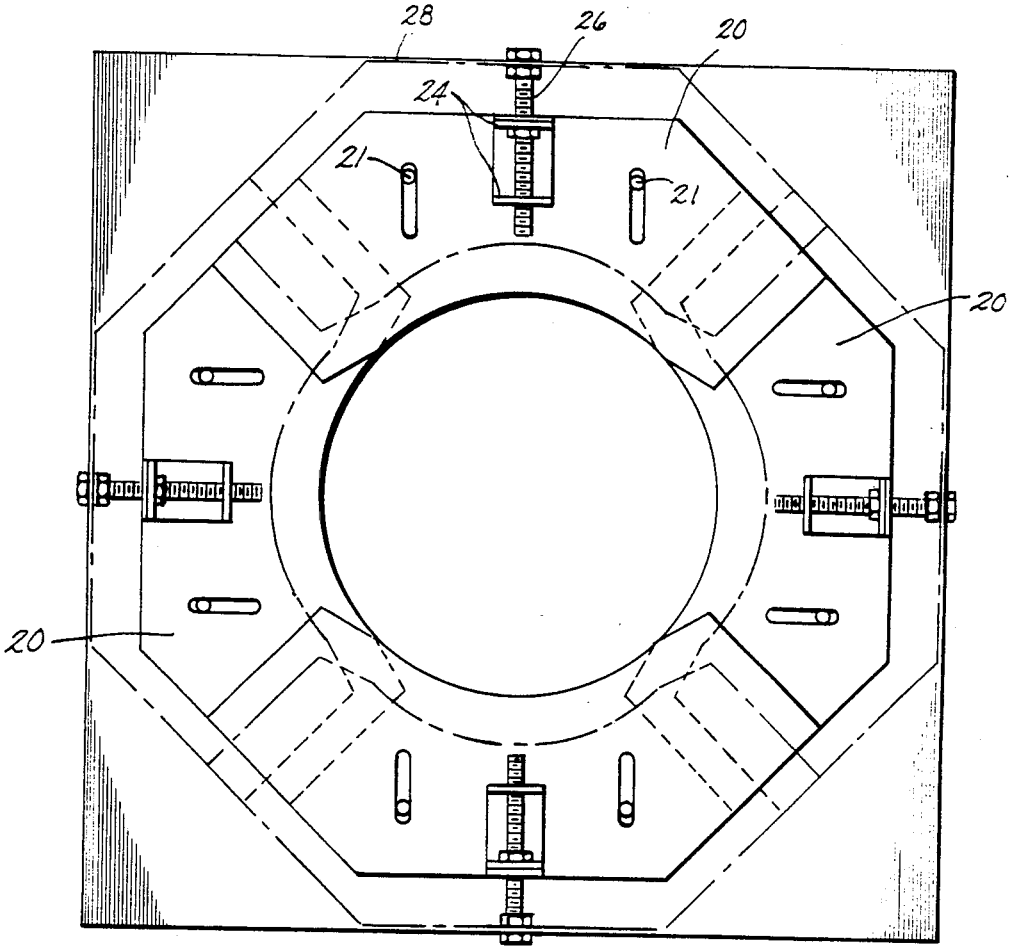
FIG. 4 is an enlarged end sectional view of the profiling device around the burner in the combustion chamber.

The pollutant emission is generated within spray booth 10. Prior art largely involves the emissions being collected by an air propelling exhaust fan and motor 13 and, for example, directed to the atmosphere. This present apparatus diverts this exhaust gaseous stream through a filter 11 to remove particulate or larger effluent from the air stream, and then into the intake side of blower fan 12. The gaseous stream is then compressed and propelled to the novel burner arrangement 6. As compressed, the pressure is in the range of about 1 to 2 psig, with optimum being about 1.5 psig. Flow conditions of the gaseous stream past the central burner unit 22 in this pressurized chamber have been found to be significant. The flow conditions are variable and controlled by profile plate assembly 14 to obtain the optimum for the combustible concentrations encountered. Specifically, control is achieved by employing a series of edge-overlapping profiling plate elements 20 (FIG. 4) arranged peripherally around the central burner 22, and radiating therefrom, each plate being movable radially toward and away from the burner, to define a conrolled width flow annulus between the collective plates and the burner. The plates resemble an iris. The exhaust gases containing combustible organic substances are caused to flow through this annulus over the surface of the conical burner. The burner is preferably of conventional type, generally frustoconical in shape, oriented with its major diameter downstream, e.g. the type known in the trade as a "Wing Cone" burner. It typically has orifices in its periphery. A fuel line (not shown) connects the burner to an external supply of fuel.

It has been determined that combustion of the pressurized gases can be optimized by gaseous flow control using this profiling iris. Each plate of the iris has a U-shaped supporting bracket 24, the flanges of which are threadably attached to an adjustment control bolt 26. The radially outer head end of the bolt is anchored to butt rotatably on a peripheral frame mount 28 affixed to the interior of the combustion chamber. The head of the bolt protrudes outside the chamber for access thereto. Each plate, four of which are used in the illustrative embodiment, is guided by fixed pins 21 extending through a pair of slots 20' in the plate.

The flow area downstream of the burner is restricted by the duct network 15, to maintain the pressure in the chamber. This heated gas is propelled under pressure from ducting 15 to piping network 16 in the drying oven 5. This heat from the combustion process mixes with ambient air entrained from within the oven, and used for the heat treatment process such as drying. This air-gas mixture is eventually drawn from the oven into ductwork 7 and propelled to the atmosphere by fan and motor 8. The end result is that the gases and air from spray booth 10 are discharged relatively clean of harmful pollutants.

Within this process the volatile organic compounds emitted from the coating process or spray booth are collected and processed under controlled pressure to the profiled burner arrangement to insure kindling temperatures above 600° F. as required for solvent. The burner produces the heat required to render the compounds harmless, this temperature being approximately 1400° F. The pressurized solvent laden gas undergoes further combustion within the chamber to complete the combustion. The temperature may be controlled by conventional means to regulate ambient air inflow as required by the heat treatment oven and its particular process. The atmosphere within the oven chamber may include a temperature sensor 17 for control of the upper temperature limit. This may be a thermocouple projecting into the plenum to prevent the temperature from exceeding the maximum allowable for the particular product being processed.

The embodiment set forth therefore involves circulation of solvent laden air streams from a pollutant source such as a spray booth, to the combustion chamber of the pressurized burner, into the piping network of the high velocity oven, eventually drawn into the exhaust stack 7, and discharged by fan 8 to the atmosphere. The results are increased production with lower capital equipment costs and requirements, significantly greater heat conservation with concomitant less fuel consumption and pollution control, and elimination of conventional solvent fume incinerators and the high fuel consumption rates thereof.

The embodiments of the invention in which an exclusive property or privilege is claimed are defined as follows:

1. Apparatus for treatment of exhaust gases containing volatile compounds, as from a spray booth, comprising:

a combustion chamber having a central burner therein and a fuel inlet to said burner; exhaust gas ducting to said combustion chamber upstream of said burner, and discharge ducting downstream of said burner; gas propelling means in said exhaust gas ducting for supplying exhaust gases to said combustion chamber under pressure; a series of profile defining plates peripherally around said burner and radially spaced therefrom to define an annular flow passage past said burner for pressurized exhaust gases to be combusted, and said plates having variable positioning means for radially movable relative to said burner to regulate the size of said annular flow passage.

2. The exhaust gas treatment apparatus in claim 1 wherein said burner is generally frustoconical in configuration, with its largest diameter portion downstream.

3. The exhaust gas treatment apparatus in claim 1 wherein said profile defining plates comprise in said combustion chamber a series of overlapping plate elements, each being movable radially toward and away from said burner, a fixed support mount for each plate element, and said variable positioning means between each mount and its plate element for controllably moving the plate radially.

4. The apparatus in claim 3 wherein said positioning means protrudes outside of said combustion chamber for access thereto.

5. For use in combination with a spray booth and a drying oven, apparatus for treating exhaust gases from the spray booth, comprising:

a combustion chamber, a burner in said chamber, exhaust gas ducting to said combustion chamber to conduct spray booth exhaust gases to said combustion chamber and said burner; gas propelling and pressurizing means in said exhaust gas ducting for supplying exhaust gases to said combustion chamber under pressure for combustion and heat generation; discharge ducting from said combustion chamber downstream of said burner, to conduct hot combustion gases to the drying oven, profiling means around said burner causing gases from said exhaust gas ducting to flow through an annulus past said burner for combustion and said profiling means comprises a series of elements having means for moving radially relative to said burner for control of the size of said annulus.

6. The apparatus in claim 5 wherein said propelling and pressurizing means applies a pressure of 1–2 psig to the exhaust gases in said combustion chamber.

* * * * *

UNITED STATES PATENT AND TRADEMARK OFFICE

CERTIFICATE OF CORRECTION

PATENT NO. : 4,548,579

DATED : October 22, 1985

INVENTOR(S) : Roger D. Cunningham

It is certified that error appears in the above-identified patent and that said Letters Patent is hereby corrected as shown below:

Column 4, line 8:

After "for" insert -- being--.

Signed and Sealed this

*Eleventh* Day of *March 1986*

[SEAL]

*Attest:*

DONALD J. QUIGG

*Attesting Officer*

*Commissioner of Patents and Trademarks*